US006448934B1

(12) United States Patent
Lee et al.

(10) Patent No.: US 6,448,934 B1
(45) Date of Patent: Sep. 10, 2002

(54) MULTI BAND ANTENNA

(75) Inventors: Man Wei Lee, Singapore (SG); Huan Fong Tan, Singapore (SG); Beng Tiek Yap, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/941,374

(22) Filed: Aug. 28, 2001

(30) Foreign Application Priority Data

Jun. 15, 2001 (SG) ..... 200103456-8

(51) Int. Cl.[7] ..... H01Q 1/24; H01Q 1/36
(52) U.S. Cl. ..... 343/702; 343/895; 343/725
(58) Field of Search ..... 343/895, 702, 343/725, 727, 729; H01Q 1/24, 1/36

(56) References Cited

U.S. PATENT DOCUMENTS 6,075,488 A 6/2000 Hope ..... 343/702
6,094,179 A * 7/2000 Davidson ..... 343/895
6,127,979 A 10/2000 Zhou et al. ..... 343/702
6,147,661 A * 11/2000 Nakagawa et al. ..... 343/895
6,163,301 A * 12/2000 Widfeldt ..... 343/702
6,163,307 A * 12/2000 Kim et al. ..... 343/895
6,166,697 A * 12/2000 Granqvist et al. ..... 343/702
6,188,364 B1 * 2/2001 Scordilis ..... 343/702
6,271,804 B1 * 8/2001 Yanagisawa et al. ..... 343/895

* cited by examiner

*Primary Examiner*—Hoanganh Le

(57) ABSTRACT

An antenna is provided that is adapted to operate in multiple frequency bands. The antenna consists of a first antenna element for receiving and transmitting signals in a first frequency band, and a second antenna element for receiving and transmitting signals in a second frequency band. The first antenna element has a substantially elongated conductor of a predetermined first pitch, which is coupled to a feed point. The second antenna element has a substantially meandering coil of a predetermined second pitch, which is coupled to said feed point. The substantially meandering coil comprises a plurality of first portions having a wound form and surrounding at least partly said first antenna element, and also comprises a plurality of second portions having a straight form. The first portion extends from an upper end of said second portion to a lower end of a subsequent second portion following in axial direction of the second antenna element.

12 Claims, 5 Drawing Sheets

MULTI BAND ANTENNA

FIELD OF THE INVENTION

The present invention generally relates to antennas adapted to operate in multiple frequency bands, and more particularly to multi band antennas used for wireless communication systems such as cellular telephone systems.

BACKGROUND OF THE INVENTION

Wireless communication systems, e. g. cellular telephone systems, are usually based on radio frequency (RF) waves. There are analog and digital standards in use in various regions of the world being created to provide an acceptable level of compatibility for wireless communication systems, i.e. to standardize design criteria for cellular telephone devices. The standards differ from each other significantly in their operating frequency ranges. For example, GSM (Global System for Mobile communication) is a digital standard that typically operates at a low frequency band, such as between 880 MHz and 960 MHz, while AMPS (Advanced Mobile Phone System) is an analog standard that typically operates at frequency bands between 824 MHz and 894 MHz. Further digital standards in wide use are DCS (Digital Communication System) having high frequency bands between 1710 MHz and 1880 MHz, and PCS (Personal Communication System) having operating frequencies of 1850 MHz to 1990 MHz, wherein both DCS and PCS are based on GSM.

Cellular telephone devices used for wireless communication systems necessarily include an antenna for receiving and transmitting radio frequency signals such as the widely employed monopole antennas. Since the resonating frequency of an antenna depends on the length of the antenna in a known manner due to the wavelength of the RF-waves, a certain antenna can be used only for a certain frequency range. Due to the different standards, however, it is desirable that one and the same cellular telephone device is able to operate within widely separated frequency bands in order to utilize more than one standard. Therefore, an antenna adapted to operate in multiple frequency bands is needed.

Furthermore, cellular telephone devices are increasingly undergoing a miniaturization to cater to consumer's demand for convenience. As a result, antennas utilized by such devices also have to become smaller and lighter. However, as antennas become smaller, the frequency bands within which they can operate typically become narrower. Consequently, helix antennas are often employed for cellular telephone devices operating within multiple frequency bands. Helix antennas typically include a conducting member wound in a helical pattern. As the radiating element of a helix antenna is wound about an axis, the axial length of the helix antenna can be considerably less than the length of a comparable monopole antenna. Hence, helix antennas can be used where the length of a monopole antenna is too extended.

Accordingly, there is a need for an antenna to be relatively compact in size and to be capable of operating in multiple widely separated frequency bands such as GSM and PCS. Small multi band antennas providing adequate bandwidth in at least two frequency bands are known.

For instance, U.S. Pat. No. 6,075,488 to Hope discloses a broadband antenna that includes a centrally positioned high frequency-radiating element surrounded by a dielectric support element, and a linear radiating element in the form of a wire wound over the dielectric support element and extending generally over the entire length of centrally positioned high frequency radiating element, thus defining an over-wound helical coil. The length of the linear radiating element is such that it supports resonance at a lower frequency. Such an antenna can resonate at two broadly separated frequencies and, therefore, is configured for dual frequency band operation.

Furthermore, U.S. Pat. No. 6,127,979 to Zhou et al. reveals a multi band antenna that comprises a fixed whip antenna element and a helical coil antenna element coupled to a single feed point. The antenna is reduced in size by attaching a disc to the end of the whip antenna element, while decreasing the pitch of the helical coil antenna element. A dielectric material surrounds the whip antenna element and provides support for the helical coil antenna element.

It turned out that a certain precisely predetermined distance between the top of the whip antenna element and the corresponding end of the helical coil antenna element is extremely important with regard to the performance of the antenna. However, mounting of the helical coil antenna element often causes variations to this distance. Such variations are difficult to control due to the elasticity of the helical coil antenna element. In addition, because of low production costs, the helical coil antenna element is usually manufactured with wide tolerances. Thus, inaccuracies in the pitch of the helical coil antenna element occur.

SUMMARY OF THE INVENTION

The present invention provides an antenna, which is adapted to operate in multiple frequency bands, and consists of a first antenna element for receiving and transmitting signals in a first frequency band, and a second antenna element for receiving and transmitting signals in a second frequency band. The first antenna element has a substantially elongated conductor of a predetermined first pitch, which is coupled to a feed point. The second antenna element has a substantially meandering coil of a predetermined second pitch, which is coupled to said feed point. The substantially meandering coil comprises a plurality of first portions having a wound form and surrounding at least partly said first antenna element, and also comprises a plurality of second portions having a straight form. The first portion extends from an upper end of said second portion to a lower end of a subsequent second portion following in axial direction of the second antenna element.

In accordance with a preferred embodiment of the present invention, the second portions can extend parallel to the elongated conductor of the first antenna element. Also, the first portions can extend concentric to the elongated conductor of the first antenna element. Preferably, the first portions and the second portions can be perpendicular.

Further in accordance with a preferred embodiment of the present invention, one first portion can be arranged at the top and another first portion can be arranged at the bottom of the second antenna element. In addition, the first portion arranged at the bottom of said second antenna element can be formed as a closed ring.

Still further in accordance with a preferred embodiment of the present invention, the first antenna element can be a fixed whip antenna. Preferably, the first antenna element can have a disk on the top of the substantially elongated conductor.

According to another embodiment of the present invention, the antenna can comprise a RF matching network that matches the first antenna element and the second antenna element.

In accordance with a preferred embodiment of the present invention, the antenna comprises a dielectric material surrounding the first antenna element, wherein the substantially meandering coil of the second antenna element is supported by the dielectric material.

Preferably, the second antenna element can be made of a punched-out metal sheet or of a formed plastic that is plated with copper. Moreover, in accordance with a preferred embodiment of the present invention, the second frequency band is one of a GSM and AMPS band and the first frequency band is one of a DCS and PCS band.

Antennas according to the present invention are particularly well suited for operation within wireless communication systems such as cellular telephone systems utilizing multiple, widely separated frequency bands. Furthermore, because of their small size, antennas according to the present invention can be employed within very small communications devices. Besides, because the second antenna element having the form of a substantially meandering coil comprises a plurality of first portions having a wound form and a plurality of second portions having a straight form, wherein the first portion extends from an upper end of said second portion to a lower end of a subsequent second portion following in axial direction of the second antenna element, antennas according to the present invention can be manufactured with a steady performance. The reason for this is that the second antenna element according to the present invention is more rigid and can be manufactured more accurately in the pitch than conventional helix antenna elements. As a result, the distance between the top of the first high frequency antenna element and the corresponding end of the second low frequency antenna element is easy to keep constant.

BRIEF DESCRIPTION OF THE DRAWINGS

The various features and advantages of the present invention may be more readily understood with reference to the following detailed description taken in conjunction with the accompanying drawings, wherein like reference numerals designate like parts, and in which.

DESCRIPTION OF PREFERRED EMBODIMENTS

Figure 1:
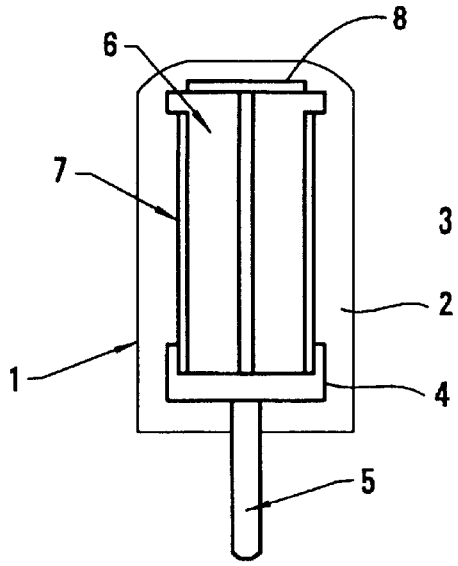
FIG. 1 is a schematic view showing an antenna adapted to receive and transmit signals in multiple frequency bands.
Figure 8:
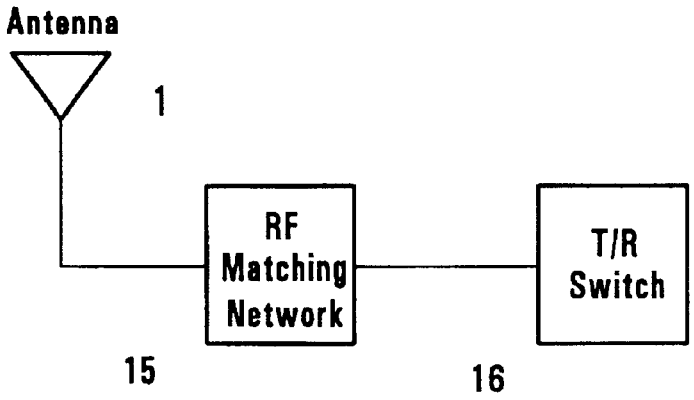
FIG. 8 is a schematic block diagram showing an interface between the antenna according to the present invention and a RF matching network.
Figure 9:
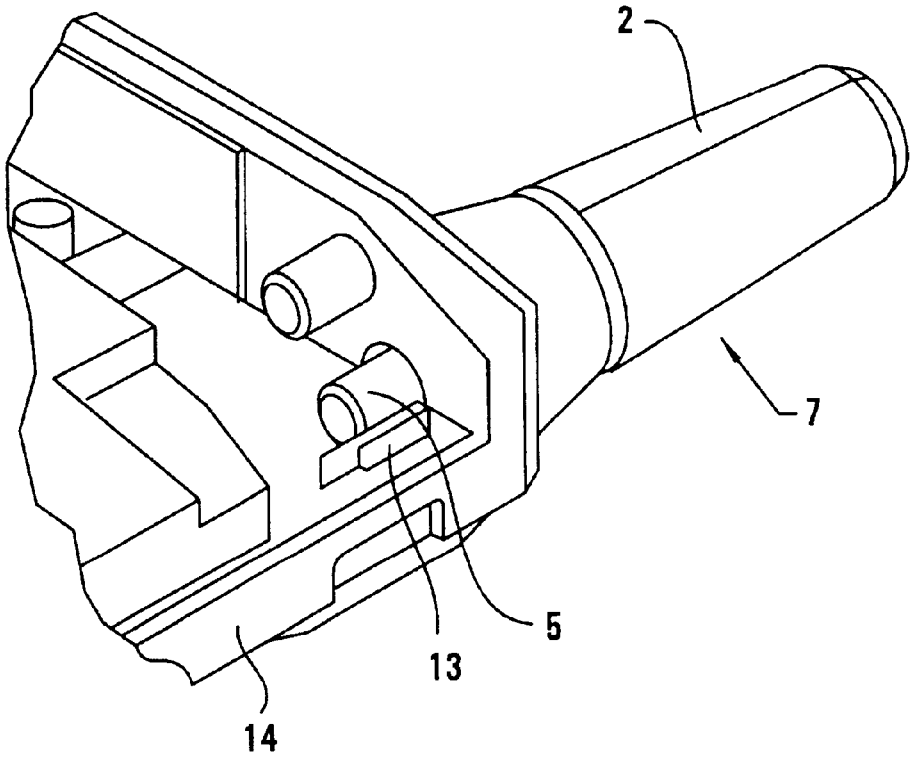
FIG. 9 is a perspective view showing how the antenna according to the present invention can be connected to a RF matching network.

Reference is now made to FIG. 1, which illustrates a dual band antenna 1 constructed and operative in accordance with the present invention. As shown in FIGS. 1 and 9, the antenna 1 comprises an outer housing or overmold 2, which is used to protect and hold together the whole antenna structure. Within the overmold 2, which defines the appearance of the antenna 1 as well, there is a first antenna element 3 for receiving and transmitting signals in a high frequency band, i.e. in the DCS band. The first antenna element 3 has a substantially elongated conductor or monopole of a predetermined pitch, which elongated conductor forms a fixed whip antenna and which is coupled to a feed point 4. The feed point 4 extends to a coupling portion 5, which is electrically connected to a RF matching network 15 as shown in FIG. 8. The RF matching network 15 is used to match the impedance of the antenna to 1 that of a T/R switch 16 and comprises several capacitors and inductors. The functioning of a similar RF matching network 16 is described in U.S. Pat. No. 6,127,979, the disclosure of which is incorporated herein by reference.

The antenna 1 further comprises a dielectric material 6 such as santoprene or polypropylene, which surrounds the first antenna element 3, and a second antenna element 7 for receiving and transmitting signals in a lower frequency band, i.e. in the GSM band. Both the first antenna element 3 and the second antenna element 7 are coupled to the feed point 4. The second antenna element 7 also has a substantially meandering coil of a predetermined pitch, which is supported by the dielectric material 6. The dielectric material 6 holds the elongated conductor of the first antenna element 3, thereby ensuring concentricity of the elongated conductor within the substantially meandering coil of the second antenna element 7. Additionally, the dielectric material 6 holds a disc 8 that is set on the top of the substantially elongated conductor to shorten the overall length of the antenna 1. In contrast to the teaching of U.S. Pat. No. 6,127,979 the dielectric material 6 is no longer required for securing the distance between the top of the second antenna element 7 and the disc 8. The reason for this is the rigidity of the second antenna element 7 caused by the substantially meandering coil.

Figure 2:
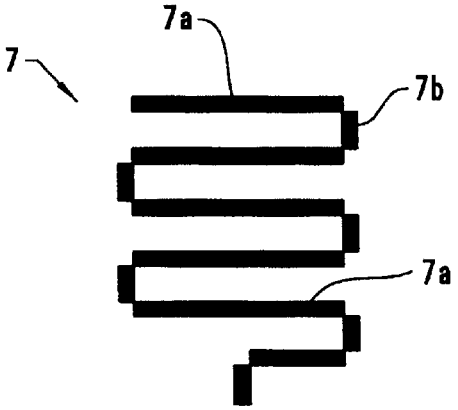
FIG. 2 is a plan view showing a low frequency antenna element according to a first embodiment of the present invention.
Figure 3:
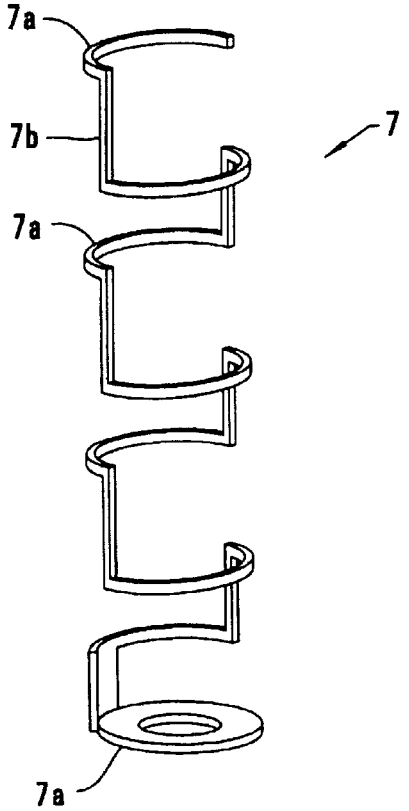
FIG. 3 is a perspective view showing a low frequency antenna element according to a second embodiment of the present invention.

Turning now to FIGS. 2 and 3, two variations of the substantially meandering coil of the second antenna element 7 according to preferred embodiments of the present invention are shown.

According to a first embodiment of the present invention, the substantially meandering coil illustrated in FIG. 2 comprises a plurality of first portions 7*a* and a plurality of second portions 7*b*. The first portions 7*a* have a wound form that concentrically surrounds the elongated conductor of the first antenna element 3 in the assembled position of the antenna 1. Since FIG. 2 is a plan view, the wound form of the first portions 7*a* cannot be seen. As opposed to the first portions 7*a,* the second portions 7*b* have a straight form so that they extend parallel to the elongated conductor of the first antenna element 3 in the assembled position of the antenna 1. Because the first portions 7*a* concentrically surround the elongated conductor, the first portions 7*a* and the second portions 7*b* are perpendicular. FIG. 2 clearly depicts that the second portions 7*b* are arranged so that a single first portion 7*a* extends from the upper end of a second portion 7*b* to the lower end of a subsequent second portion 7*b* following in the axial direction of the second antenna element 7.

FIG. 3 shows a substantially meandering coil according to a second embodiment of the present invention, which is similar to the second antenna element 7 described above. FIG. 3 is a perspective view, which clearly shows that the first portions 7*a* have a wound form surrounding partly the elongated conductor of the first antenna element 3. The substantially meandering coil according to FIG. 3 has one first portion 7*a* that is arranged at the top of the second antenna element 7 and another first portion 7*a* that is arranged at the bottom of the second antenna element 7. Because of the first portions 7*a* arranged at the top and the bottom of the second antenna element 7, a precise pitch of the substantially meandering coil can easily be provided. Moreover, the first portion 7*a* arranged at the bottom of the second antenna element 7 is formed as a closed ring. The inside diameter of the ring corresponds to the diameter of the elongated conductor or monopole of the first antenna element 3, thus, allowing a centering of first antenna element 3 and second antenna element 7.

Figure 4:
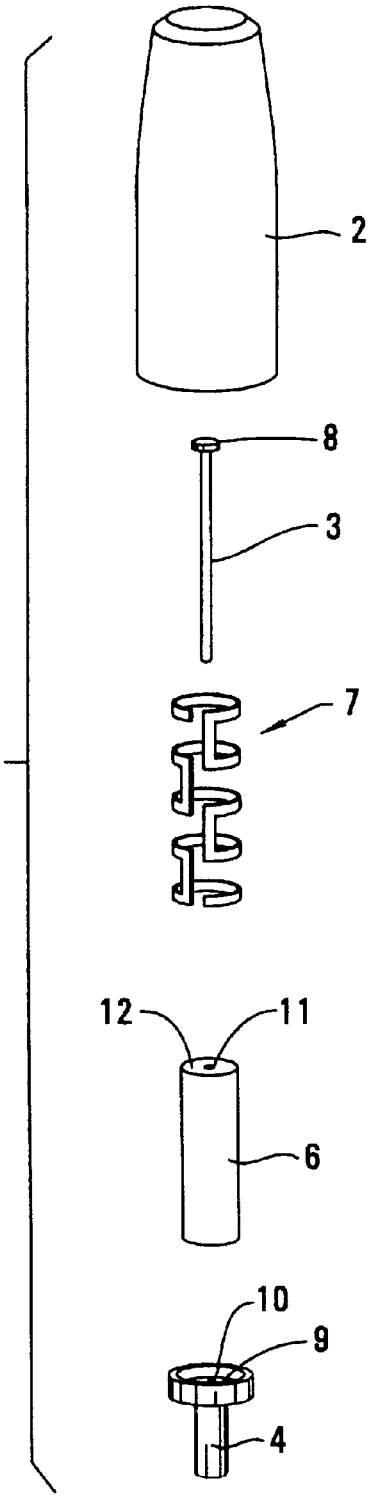
FIG. 4 is an exploded view showing components of an antenna according to a modification of the second embodiment of the present invention.
Figure 5:
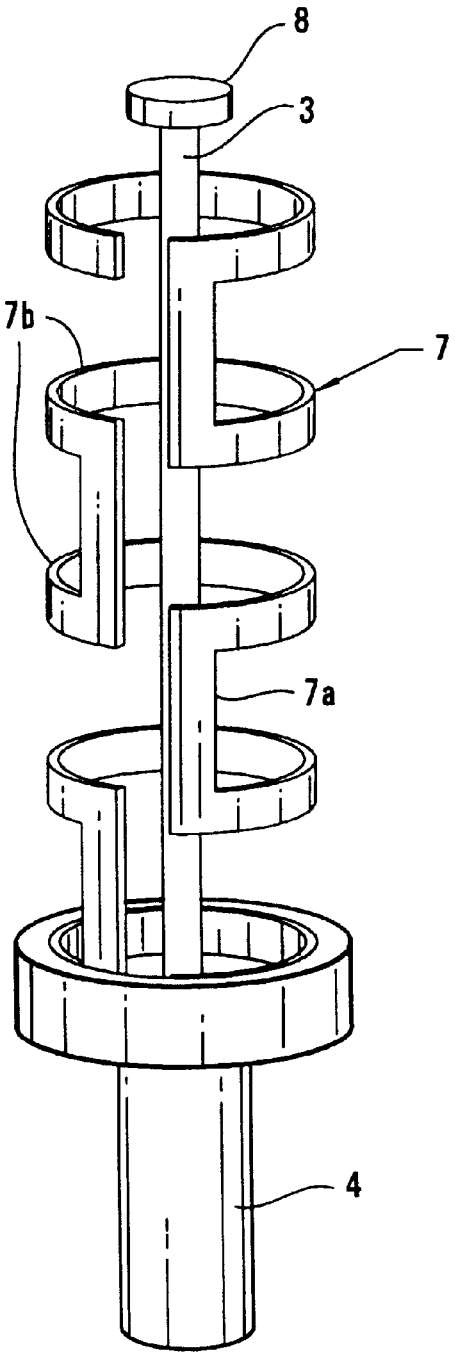
FIG. 5 is a perspective view showing partially assembled components according to FIG. 4.

Referring to FIGS. 4 and 5, a modification of the second embodiment of the present invention is shown. The second antenna element 7 according to FIGS. 4 and 5 comprises first portions 7*a* both at the top and the bottom of the substantially meandering coil. Contrary to the second antenna element 7 of FIG. 3, the first portions 7*a* of the substantially meandering coil have an almost completely closed ring form. Consequently, the first portions 7*a* nearly entirely surround the elongated conductor of the first antenna element 3. The substantially meandering coil according to FIGS. 4 and 5 can be simply made of a metal sheet by appropriate punching out and bending. The thickness of the metal sheet ensures a satisfactory rigidity of the second antenna element 7. Alternatively, the substantially meandering coil can be made of a formed plastic that is plated with copper or any right metal.

FIG. 4 illustrates the components of the antenna 1 in an exploded view. FIG. 5 shows the components of FIG. 4 in an assembled position of the antenna 1, but without the dielectric material 6 and the overmold 2. As can be seen from FIG. 4, the antenna 1 can simply be assembled by introducing both the first antenna element 3 and the second antenna element 7 in appropriate recesses 9, 10 of the feed point 4, thereby fixing and aligning the elongated conductor of the first antenna element 3 and the substantially meandering coil of the second antenna element 7. Moreover, the dielectric material 6 secures a reliable and lasting alignment of first antenna element 3 and second antenna element 7. To this end, the cylindrical dielectric material 6 has a bore 11 for receiving the elongated conductor or monopole of the first antenna element 3, a supporting surface 12 for supporting the disc 8 of the first antenna element 3, and an outside diameter adapted to the internal diameter of the substantially meandering coil. As a result, there is both a positive locking and an additional frictional connection of the first antenna element 3, the second antenna element 7, and the cylindrical dielectric material 6 into the recess 9 of the feed point 4.

Figure 6:
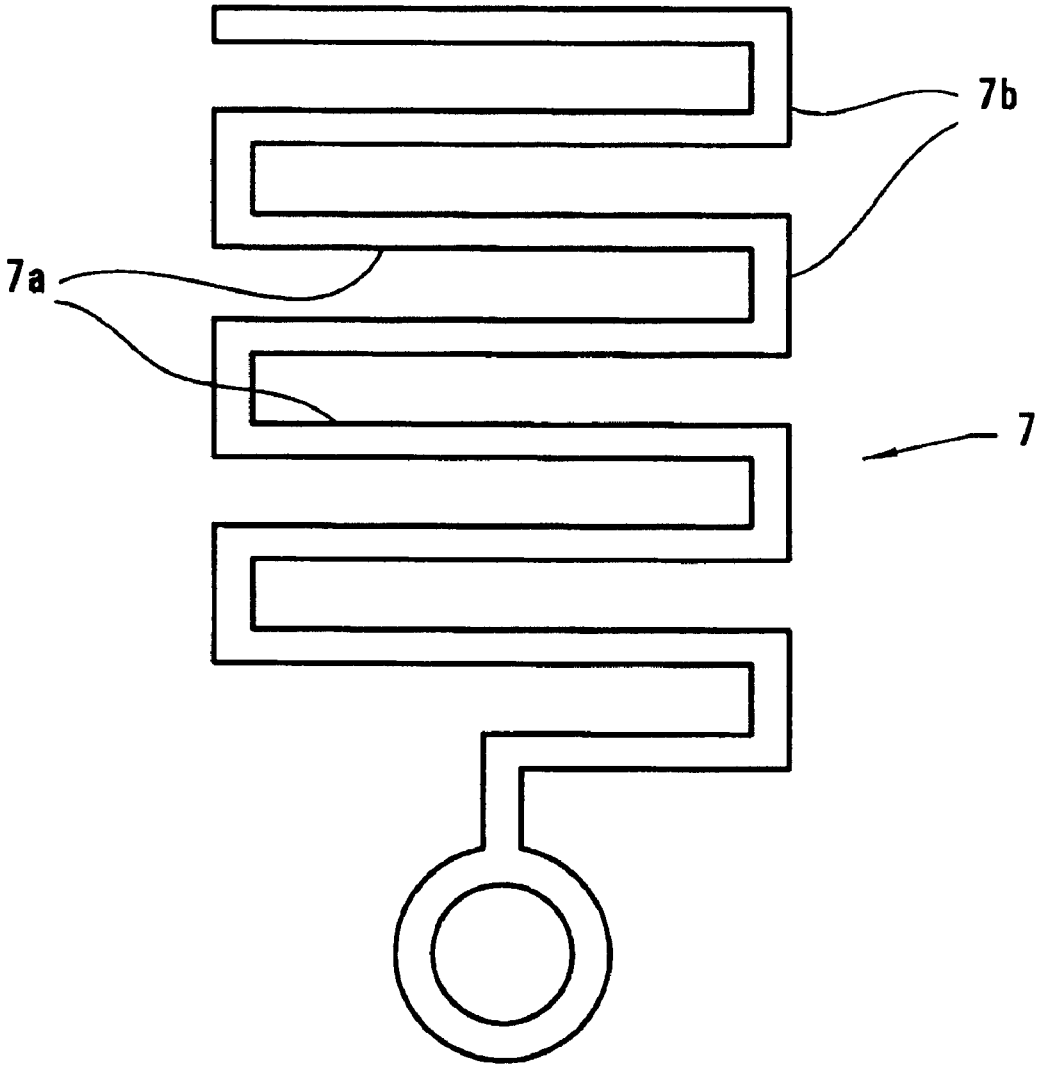
FIG. 6 is a schematic view showing a low frequency antenna element according to a third embodiment of the present invention.

Turning now to FIG. 6, a third embodiment of the present invention is shown. As shown in FIG. 6, the substantially meandering coil of the second antenna element 7 comprises a plurality of first portions 7*a* and a plurality of second portions 7*b*. In contrast to the first and second embodiments of the present invention, the second antenna element 7 illustrated in FIG. 6 consists of a flexible foil, in particular a flexible PCB, which can be wrapped around the first antenna element 3 or the dielectric material 6 surrounding the first antenna element 3.

Figure 7:
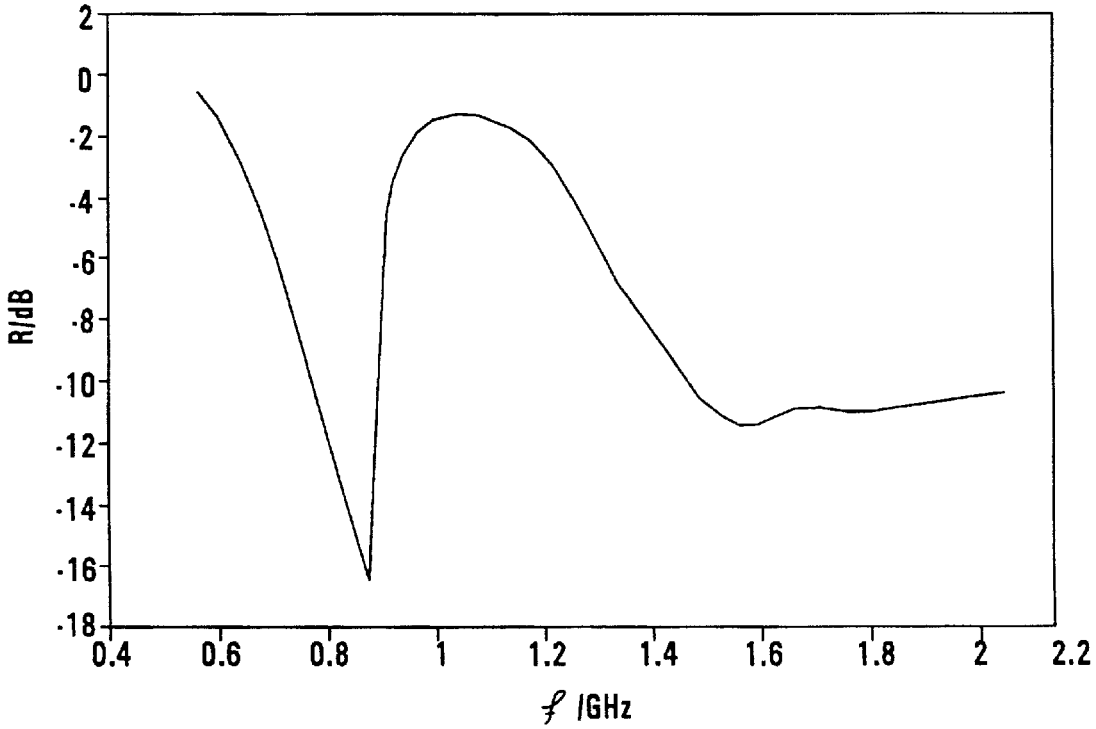
FIG. 7 is a chart showing the frequency response of an antenna according to the present invention.

With reference to FIG. 7, which illustrates a graph showing the return loss R in 2 dB increments as a function of frequency f. As can be seen in the figure, the antenna according to the present invention operates signals in frequency bands of about 830 MHz to about 960 MHz and of about 1710 MHz to about 1990 MHz, which cover the widespread standards of GSM, AMPS, DCS and PCS. While the present example sets forth that the high and low frequency bands are DCS and GSM bands, respectively, one skilled in the art will appreciate that other combinations of frequency bands may be implemented by modifying the length of the first antenna element 3 and the second antenna element 7 without departing from the spirit and scope of the present invention. For example, other possible combinations of low and high bands could include GSM+PCS, AMPS+DCS, AMPS+PCS, or any other combination of one and more lower and higher frequency bands of known standards.

FIG. 9 shows a 3-dimensional perspective view of how the antenna 1 can be interfaced to a system. This will form part of the antenna feeding mechanism to the transceiver. In particular, the coupling portion 5 is connected to mechanical and electrical contacts 13 which are arranged in the housing 14 of the system, the antenna 1 is connected to. Via the mechanical and electrical contacts 13, the antenna 1 is coupled to the respective network in the system.

In summary, the antenna 1 discussed above by means of preferred embodiments operates as do prior art dual band antennas over a wide frequency range and is comparatively small sized. Therefore, the antenna 1 is particularly well suited for operation within wireless communication systems, e. g. cellular telephone devices. However, the antenna 1 of the present invention improves the production with regard to a steady performance of the antenna. The reason for this is that the second antenna element 7 is more rigid and can be manufactured more accurately in the pitch than conventional helix antenna elements because of the inventive arrangement of first portions 7*a* and second portions 7*b*. As a result, the distance between the disc 8 on the top of the elongated conductor of the first antenna element 7 and the adjacent end of the first portion 7*a* arranged at the top of the substantially meandering coil is easy to keep constant.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. An antenna adapted to operate in multiple frequency bands, comprising:

a first antenna element for receiving and transmitting signals in a first frequency band having a substantially elongated conductor of a predetermined first pitch permanently electrically connected to a feed point;

a second antenna element for receiving and transmitting signals in a second frequency band having a substantially meandering coil of a predetermined second pitch permanently electrically connected to said feed point, wherein said second frequency band does not overlap with said first frequency band;

said substantially meandering coil comprising a plurality of first portions having a wound form and surrounding at least partly said first antenna element, and also comprising a plurality of second portions having a straight form;

said first portion extending from an upper end of said second portion to a lower end of a subsequent second portion following in the axial direction of the second antenna element.

2. The antenna according to claim 1, said second portions extending parallel to said elongated conductor of said first antenna element.

3. The antenna according to claim 1, said first portions extending concentric to said elongated conductor of said first antenna element.

4. The antenna according to claim 1, said first portions and said second portions being perpendicular.

5. The antenna according to claim 1, one first portion being arranged at the top and another first portion being arranged at the bottom of said second antenna element.

6. The antenna according to claim 5, said first portion arranged at the bottom of said second antenna element being formed as a closed ring.

7. The antenna according to claim 1, said first antenna element being a fixed whip antenna.

8. The antenna according to claim 1, said first antenna element having a disk on the top of said substantially elongated conductor.

9. The antenna according to claim 1, a RF matching network matching said first antenna element and said second antenna element.

10. The antenna according to claim 1, comprising a dielectric material surrounding said first antenna element, wherein said substantially meandering coil of said second antenna element is supported by said dielectric material.

11. The antenna according to claim 1, said second antenna element being made of a punched out metal sheet or of a formed plastic that is plated with copper.

12. The antenna according to claim 1, said second frequency band being one of a GSM and AMPS band and said first frequency band being one of a DCS and PCS band.

* * * * *